US010434548B1

(12) United States Patent
Shah et al.

(10) Patent No.: US 10,434,548 B1
(45) Date of Patent: Oct. 8, 2019

(54) BIOSAFETY CABINET MONITOR

(71) Applicant: LifeCell Corporation, Branchburg, NJ (US)

(72) Inventors: Vasant Shah, Fords, NJ (US); Michael Kuehne, Wall Township, NJ (US); Joseph Junio, Jr., Edison, NJ (US); Russell Saputo, Sparta, NJ (US); Ronojit Sudhir Adyanthaya, Hamilton, NJ (US)

(73) Assignee: LifeCell Corporation, Madison, NJ (US)

( * ) Notice: Subject to any disclaimer, the term of this patent is extended or adjusted under 35 U.S.C. 154(b) by 643 days.

(21) Appl. No.: 14/721,124

(22) Filed: May 26, 2015

Related U.S. Application Data

(60) Provisional application No. 62/009,036, filed on Jun. 6, 2014.

(51) Int. Cl.
*B08B 15/02* (2006.01)

(52) U.S. Cl.
CPC ..... *B08B 15/023* (2013.01)

(58) Field of Classification Search
CPC ..... B08B 15/023
USPC ..... 454/56, 61
See application file for complete search history.

(56) References Cited

U.S. PATENT DOCUMENTS

| | | | | |
|---|---|---|---|---|
| 3,440,022 | A * | 4/1969 | Elmore | F23J 11/00 110/173 R |
| 4,856,420 | A * | 8/1989 | Poblete | B08B 15/023 312/138.1 |
| 5,090,303 | A | 2/1992 | Ahmed | |
| 5,215,497 | A | 6/1993 | Drees | |
| 5,562,537 | A * | 10/1996 | Zver | B08B 15/023 454/56 |
| 5,665,128 | A | 9/1997 | Peters et al. | |
| 5,988,860 | A | 11/1999 | Hefferen et al. | |
| 6,692,346 | B2 | 2/2004 | Bastian et al. | |
| 6,914,532 | B2 * | 7/2005 | Crooks | F24F 11/0086 340/506 |
| 7,001,263 | B2 | 2/2006 | Shaben | |
| 2007/0105494 | A1 * | 5/2007 | Lin | B08B 15/023 454/299 |
| 2013/0035025 | A1 * | 2/2013 | Chalou | B08B 15/02 454/61 |

* cited by examiner

*Primary Examiner* — Gregory L Huson
*Assistant Examiner* — Dana K Tighe
(74) *Attorney, Agent, or Firm* — McCarter & English, LLP

(57) ABSTRACT

A lab processing device is provided. The device may include a container with an open side, a sash located on the open side and an airflow sensor to measure airflow to or from the interior volume of the container. The device can include a light source configured to be enabled or disabled depending on the location of the sash or measurements of the airflow sensor.

38 Claims, 2 Drawing Sheets

BIOSAFETY CABINET MONITOR

RELATED APPLICATION

This application claims the benefit of priority of U.S. Provisional Application Ser. No. 62/009,036, entitled "Bio-Safety Cabinet Monitor," filed Jun. 6, 2014, the content of which is hereby incorporated by reference in its entirety.

BACKGROUND OF DISCLOSURE

The present disclosure relates to a lab processing device, and more particularly, to a device including an airflow sensor and a light source as an indicator of the operation of the device.

A biosafety cabinet (lab hood) is an enclosed laboratory workspace with an access opening for safely working with chemical or biologic materials. Such cabinets or hoods allow processing of lab samples and use of potential harmful chemicals without significant risk of contamination of the materials or harm to lab personnel. Accordingly, laboratories rely on safety cabinets or hoods for safe and effective processing of chemical or biologic material.

In general, biosafety cabinets include an exhaust system and closure (sash). The exhaust system can vent air from within the cabinet to an external source, thereby preventing flow of potentially harmful materials into the lab environment. Further, the sash can be raised and lowered to allow access to the cabinet when needed (e.g., for service or cleaning), while minimizing the opening, thereby preventing contamination of samples and the lab environment.

The sash and exhaust system are important safety components of lab hoods. Accordingly, when the exhaust system is not functioning properly, or when the sash is at an unsafe level (too high or low). Users should be alerted so that further work is deterred until the problem is corrected. Current airflow monitor systems, however, have been known to malfunction and may not be effective at alerting users of appropriate sash location. Accordingly, the present disclosure provides a lab processing device incorporating improved airflow sensors and alarms systems.

According to certain embodiments, a lab processing device is provided. The device can comprise a container body comprising an interior volume with at least one open side, and an exhaust system configured to cause air to flow from the interior volume to outside of the interior volume. The device can further comprise at least one airflow sensor configured to measure airflow to or from the interior volume. In addition, the device can comprise at least one light source for illuminating the interior volume of the container body configured to be disabled or enabled based on a measurement of the airflow sensor. The light source can be positioned within the container body, e.g., on the walls or ceiling of the container body to allow light produced by the light source to shine on or within the interior volume. Alternatively, the light source may be adjacent the interior volume to provide light of sufficient intensity to allow lab personnel to work in the container body. The light source can include one or more separate light sources and have controllable intensities to provide sufficient working light.

The device can further comprise a sash located on the at least one open side of the container body. The sash can be configured to open and close.

Further, the device can comprise at least one sensor configured to sense the location of the sash. In addition, the at least one sensor can include a sensor configured to determine if the location of the sash is below a predetermined level. Furthermore, the at least one sensor can comprise a second sensor configured to determine if the location of the sash is above a predetermined level. In addition, the light source can be configured to be disabled if the location of the sash is below a predetermined upper level and above a predetermined lower level. Additionally, the at least one sensor can be configured to determine if the sash is opened less than a predetermined degree. Also, the at least one sensor can be configured to determine if the sash is opened beyond a predetermined degree. The light source can be configured to be disabled if the sash is opened below a predetermined upper degree and above a predetermined lower degree.

The device can further comprise at least one control system configured to disable the at least one light source based on a measurement of the at least one airflow sensor. The at least one control system can comprise a control system configured to disable the at least one light source based on a measurement of the at least one sensor.

According to other embodiments, the device can comprise a container body comprising an interior volume with at least one open side and an exhaust system configured to cause air flow from the interior volume to outside of the interior volume. The device can further comprise a sash located on the at least one open side of the container body configured to move up and down. The device can further comprise at least one light source for illuminating the interior volume of the container body configured to be disabled or enabled based on a measurement of the airflow sensor.

According to other embodiments, a method of operating a lab processing device is provided. The method can comprise selecting a container body comprising an interior volume with at least one open side; and activating an exhaust system configured to cause air to flow from the interior volume to outside of the interior volume. The method can further comprise providing at least one airflow sensor configured to measure airflow to or from the interior volume and providing at least one light source in the interior volume of the container body configured to become disabled or enabled based on a measurement of the airflow sensor.

The method can further comprise providing a sash located on the at least one open side of the container body. The sash is configured to move up and down.

The method can further comprise providing at least one sensor configured to sense the location of the sash. The at least one sensor can include a sensor configured to determine if the location of the sash is below a predetermined level. The at least one sensor can also include a second sensor configured to determine if the location of the sash is above a predetermined level. In addition, a light source for illuminating the interior volume of a container body can be configured to be disabled if the location of the sash is below a predetermined upper level and above a predetermined lower level. Also, the at least one sensor can be configured to determine if the sash is opened below a predetermined degree, and/or configured to determine if the sash is opened above a predetermined degree. Therefore, the light source can be configured to be disabled if the sash is opened below a predetermined upper degree and above a predetermined lower degree.

The method can further comprise providing at least one control system configured to disable the at least one light source based on a measurement of the at least one airflow sensor. The at least one control system can further include a control system configured to disable the light source based on a measurement of the at least one sensor.

DESCRIPTION OF EXEMPLARY EMBODIMENTS

Reference will now be made in detail to certain exemplary embodiments according to the present disclosure, certain examples of which are illustrated in the accompanying drawings. Wherever possible, the same reference numbers will be used throughout the drawings to refer to the same or like parts.

In this application, the use of the singular includes the plural unless specifically stated otherwise. In this application, the use of "or" means "and/or" unless specifically stated otherwise. Furthermore, the use of the term "including", as well as other forms, such as "includes" and "included", is not limiting. Any range described herein will be understood to include the endpoints and all values between the endpoints.

The section headings used herein are for organizational purposes only and are not to be construed as limiting the subject matter described. All documents, or portions of documents, cited in this application, including but not limited to patents, patent applications, articles, books, and treatises, are hereby expressly incorporated by reference in their entirely for any purpose.

Figure 1:
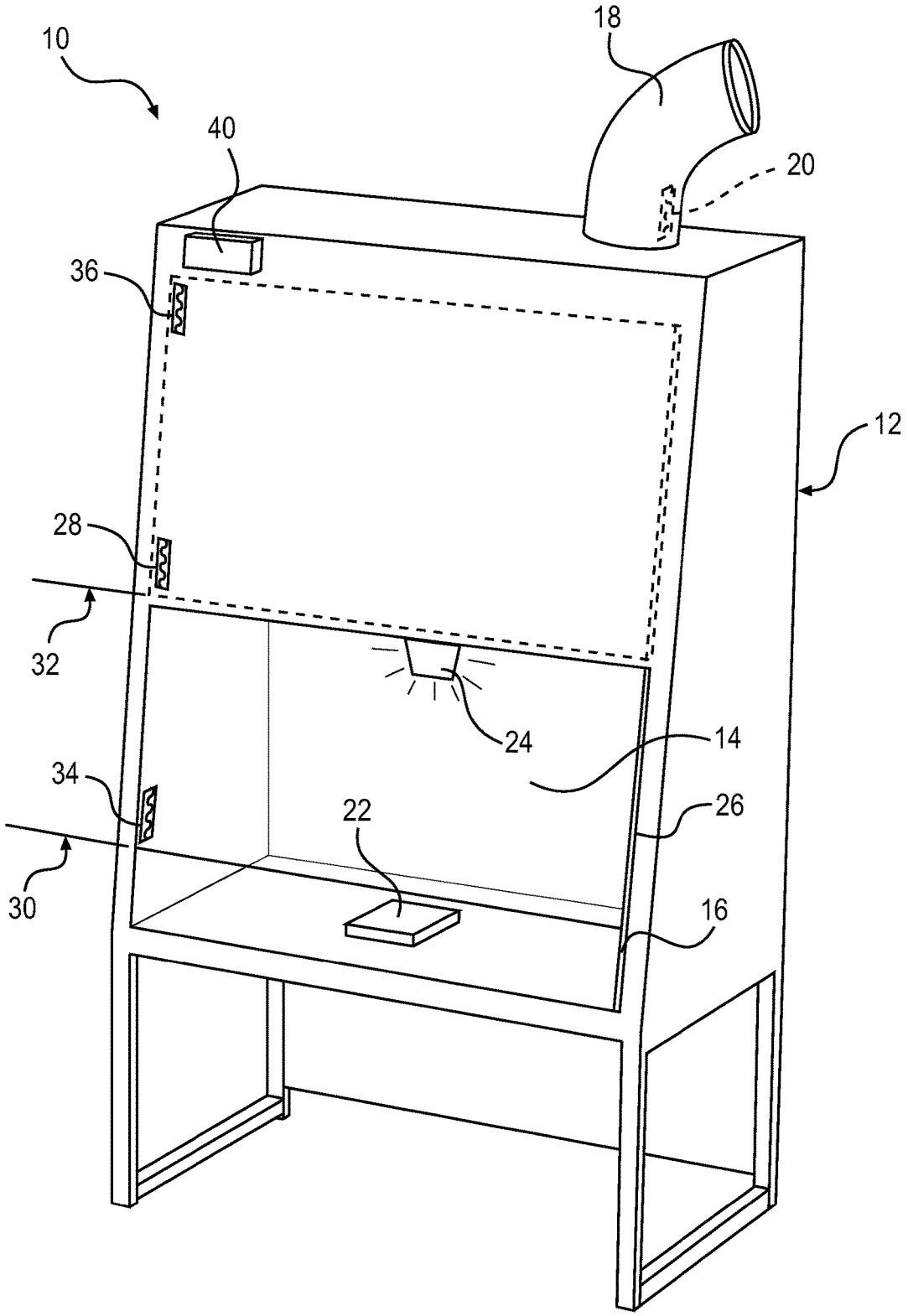
FIG. 1 illustrates a lab processing device, according to certain embodiments.

The present disclosure relates to a lab processing device, and more particularly, to a device that uses a light source as an alarm system to identify problems with hood airflow or sash position. FIG. 1 illustrates a lab processing device 10, according to certain embodiments. As shown, the device 10 can comprise a container body 12 comprising an interior volume 14 with at least one open side 16 and an exhaust system 18 configured to cause air to flow from the interior volume 14 to outside of the interior volume 14. The device 10 can further comprise at least one airflow sensor 20 configured to measure airflow to or from the interior volume 14 of the container body 12 and at least one light source 24 for illuminating the interior volume 14 of the container body 12.

As noted above, the container body 12 includes at least one open side 16 so that a user can access inside the interior volume 14. The container body 12 can have different sizes depending on the size of a sample materials 22 to be processed and laboratory space.

Typical lab processing devices or biosafety cabinets are categorized depending on the level of user and environmental protection and the level of product protection desired. For example, the inward flow of air and the exhaust systems are the factors in controlling the contamination of products/samples and the environment. Therefore, the device 10 can have different exhaust systems 18 depending on the desired class level.

As noted, the device 10 can include at least one airflow sensor 20 configured to measure airflow, directly or indirectly, to or from the interior volume 14 of the container body 12. In order to measure the airflow indirectly to or from the interior volume 14 of the container body 12, the airflow sensor 20 can include a pressure differential sensor to measure the air pressure of the interior volume 14 of the container body 12 and the air pressure of the outside of interior volume 14; thereby, providing an indirect indication of the direction and value of the airflow to or from the interior volume 14 of the container body 12. Further, the airflow sensor 20 can alternatively include a direct flow measurement device configured to measure velocity or direction of airflow.

As explained above, in order to protect the user, environment, and sample materials 22 from hazardous materials, bacteria, viruses, or any kind of contamination, there should be an air flow through the exhaust system 18 from the interior volume 14. The airflow sensor 20, therefore, is configured to sense the flow of air from the interior volume 14 out of the interior volume 14 and/or through the exhaust system 18. The airflow sensor 20 can be positioned in any place inside the interior volume 14 of the container body 12 or any place inside the exhaust system 18, or at a junction between the exhaust system 18 and interior volume 14. For example, FIG. 1 illustrates an airflow sensor 20 inside the exhaust system 18 adjacent the interior volume 14.

As discussed above, the present disclosure improves the alarm system of the existing lab processing devices or biosafety cabinets by incorporating the light source 24 into a system for notifying users of potential problems with the exhaust system or sash positions. The at least one light source 24 is located in the interior volume 14 of the container body 14 and is configured to provide sufficient light for user to operate. Any suitable light source 24 can be selected, including standard light bulbs, light emitting diodes (LED), or fluorescent lights.

The device 10 can also include a sash 26 located on the at least one open side 16 of the container body 12. The sash 26 is configured to open or close the at least one open side 16 of the container body 12. The sash 26 can move up and down or can swing and pivot. During operation, the sash 26 is generally positioned at or below a predetermined level 30. The level 30 is a lower level selected to allow sufficient access to the working area 14 of the device 10, while preventing excess space for potential contamination of the cabinet, samples 22, or lab environment. Therefore, as discussed below, the light source 24 can be configured to be disabled if the sash 26 is above a lower level 30 and below an upper lever 32.

As noted above, in addition to the sliding mechanism which results to moving the sash 26 up and down the open side 16, the sash 26 can open and close the open side 16 by pivoting mechanism. As a result, the light source 24 can be configured to be disabled if the sash 26 is opened more than a lower predetermined degree or less than an upper predetermined degree. The lower predetermined degree can be when the sash 26 is pivoted, for example, 20 degrees, 30 degree, 40 degrees, or any values or ranges between 10 and 50 degrees; therefore, the sash 26 is located at the predetermined level 30. The upper predetermined degree can be when the sash 26 is opened 80 to 90 degrees or greater; therefore, the sash 26 is located at the predetermined level 32. As such, the light source 24 is only operative when the sash 26 is placed low enough to allow safe operation by a user, or at a wide open level suitable for maintenance or cleaning operations.

Further, the device 10 can include at least one sensor 28 configured to sense the location of the sash 26. In addition, the at least one sensor 28 can comprise a sensor 34 configured to determine if the location of the sash 26 is at or below the predetermined lower level 30. In addition, the device can include a second sensor 28 configured to determine if the location of the sash 26 is at or above a predetermined upper level 32.

As noted, the light source 24 can be configured to be disabled or enabled based on a measurement of the airflow sensor 20. The device 10 can include at least one control system 40 configured to disable the at least one light source 24 based on a measurement of the at least one airflow sensor 20. For example, if the airflow sensor 20 does not sense a positive air flow from the interior volume 14 to the exhaust system 18, or if the airflow is below a desired level or even reversed, the at least one control system 40 will disable the at least one light source 24 to alert the user as to a problem with the exhaust system.

In addition, in some embodiments, the light source 24 is configured to become disabled or enabled based on a position of the sash 26. Accordingly, the device 10 can include a control system 40 configured to disable the light source 24 based on a measurement of the at least one sensor 28. For example, when the at least one sensor 28 senses that the position of the sash 26 is not below the lower lever 30 or above the upper level 32, the at least one control system 40 will disable the at least one light source 24.

Figure 2:
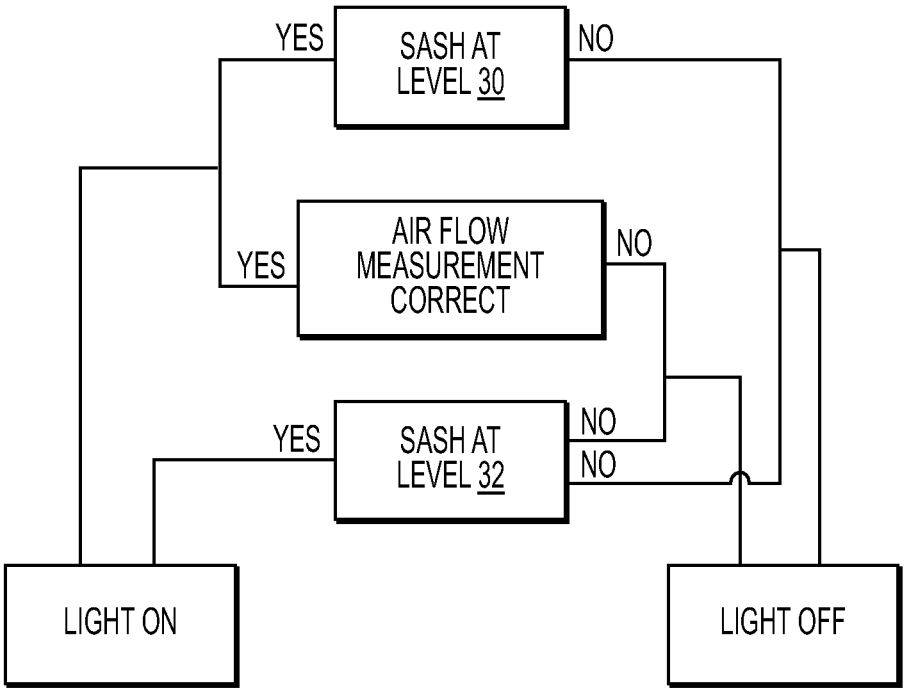
FIG. 2 illustrates a diagram of a lab processing device, according to certain embodiments.

FIG. 2 illustrates the operation of control system 40 together with the at least one light source 24. As noted above the present disclosure improves the alarm system by using at least one light source 24 to alert the user. Therefore, the at least one control system 40 will disable the at least one light source 24 if certain conditions are not met. For example, when a user is planning to work in the biosafety cabinet but did not place the sash 26 at or below the predetermined level 30 or the sash 26 is opened more than 20 degrees, therefore the sash 26 is not at a predetermined level 30, the at least one light source 24 will be disabled. Also, if during the operation, the position of the sash 26 changes unacceptably or airflow measurement aberrations are detected, the at least one light source 24 will be disabled, thereby alerting the user to stop working.

While the invention has been described in conjunction with the detailed description thereof, the foregoing description is intended to illustrate and not limit the scope of the invention, which is defined by the scope of the appended claims. Other aspects, advantages, and modifications are within the scope of the following claims.

The invention claimed is:

1. A lab processing device comprising:

a container body comprising an interior volume with at least one open side;

an exhaust system configured to cause air to flow from the interior volume to outside of the interior volume;

at least one airflow sensor configured to measure airflow to or from the interior volume; and at least one light source located in the interior volume of the container body for illuminating the interior volume of the container body and configured to be disabled when a measurement of the airflow sensor indicates that the airflow to or from the interior volume is not within a desired range.

2. The device of claim 1, wherein the at least one airflow sensor comprises a pressure differential sensor.

3. The device of claim 1, further comprising a sash located on the at least one open side of the container body.

4. The device of claim 3, wherein the sash is configured to move up and down.

5. The device of claim 3, wherein the sash is configured to pivot to open and close.

6. The device of claim 3, further comprising at least one sensor configured to sense a location of the sash.

7. The device of claim 6, wherein the at least one sensor comprises a sensor configured to determine if the location of the sash is below a predetermined level.

8. The device of claim 6, wherein the at least one sensor comprises a second sensor configured to determine if the location of the sash is above a predetermined level.

9. The device of claim 6, wherein the light source is configured to be disabled if the location of the sash is below a predetermined upper level and above a predetermined lower level.

10. The device of claim 6, wherein the at least one sensor is configured to determine if a pivot angle of the sash is below a predetermined degree.

11. The device of claim 6, wherein the at least one sensor is configured to determine if a pivot angle of the sash is above a predetermined degree.

12. The device of claim 6, wherein the light source is configured to be disabled if a pivot angle of the sash is below a predetermined upper degree and above a predetermined lower degree.

13. The device of claim 1, further comprising at least one control system configured to disable the at least one light source based on the measurement of the at least one airflow sensor.

14. A lab processing device comprising:

a container body comprising an interior volume with at least one open side;

an exhaust system configured to cause air to flow from the interior volume to outside of the interior volume;

a sash located on the at least one open side of the container body and configured to move up and down or pivot;

at least one sensor configured to sense a location or a pivot angle of the sash; and at least one light source located in the interior volume of the container body for illuminating the interior volume of the container body and configured to be disabled when the location or the pivot angle of the sash is not in a desired range.

15. The device of claim 14, wherein the at least one sensor comprises a sensor configured to determine if the location of the sash is below a predetermined level.

16. The device of claim 14, wherein the at least one sensor comprises a second sensor configured to determine if the location of the sash is above a predetermined level.

17. The device of claim 14, wherein the light source is configured to be disabled if the location of the sash is below a predetermined upper level and above a predetermined lower level.

18. The device of claim 14, wherein the light source is configured to be disabled if the pivot angle of the sash is below a predetermined upper degree and above a predetermined lower degree.

19. A method of operating a lab processing device comprising:

selecting a container body comprising an interior volume with at least one open side;

activating an exhaust system configured to cause air to flow from the interior volume to outside of the interior volume;

providing at least one airflow sensor configured to measure airflow to or from the interior volume; and causing a light source located in the interior volume of the container body for illuminating the interior volume of the container body to become disabled when a measurement of the airflow sensor indicates that the airflow to or from the interior volume is outside a desired range.

20. The method of claim 19, wherein the at least one airflow sensor comprises a pressure differential sensor.

21. The method of claim 19, further comprising providing a sash located on the at least one open side of the container body.

22. The method of claim 21, wherein the sash is configured to move up and down.

23. The method of claim 21, wherein the sash is configured to pivot to open and close.

24. The method of claim 21, further comprising providing at least one sensor configured to sense a location of the sash.

25. The method of claim 24, wherein the at least one sensor comprises a sensor configured to determine if the location of the sash is below a predetermined level.

26. The method of claim 24, wherein the at least one sensor comprises a second sensor configured to determine if the location of the sash is above a predetermined level.

27. The method of claim 24, wherein the light source is configured to be disabled if the location of the sash is below a predetermined upper level and above a predetermined lower level.

28. The method of claim 24, wherein the at least one sensor is configured to determine if a pivot angle of the sash is below a predetermined degree.

29. The method of claim 24, wherein the at least one sensor is configured to determine if a pivot angle of the sash is above a predetermined degree.

30. The method of claim 24, wherein the light source is configured to be disabled if a pivot angle of the sash is below a predetermined upper degree and above a predetermined lower degree.

31. A method of operating a lab processing device comprising:

selecting a container body comprising an interior volume with at least one open side;

activating an exhaust system configured to cause air to flow from the interior volume to outside of the interior volume;

providing a sash located on the at least one open side of the container body configured to move up and down and pivot; and providing at least one light source located in the interior volume of the container body and configured to illuminate the interior volume of the container body, which is configured to become disabled or when a location or a pivot angle of the sash is not in a desired range.

32. The method of claim 31, further comprising providing at least one sensor configured to sense the location or the pivot angle of the sash.

33. The method of claim 32, wherein the at least one sensor comprises a sensor configured to determine if the location of the sash is below a predetermined level.

34. The method of claim 32, wherein the at least one sensor comprises a second sensor configured to determine if the location of the sash is above a predetermined level.

35. The method of claim 32, wherein the light source is configured to be disabled if the location of the sash is below a predetermined upper level and above a predetermined lower level.

36. The method of claim 32, wherein the at least one sensor is configured to determine if a pivot angle of the sash is less than a predetermined degree.

37. The method of claim 32, wherein the at least one sensor is configured to determine if a pivot angle of the sash is beyond a predetermined degree.

38. The method of claim 32, wherein the light source is configured to be disabled if a pivot angle of the sash is below a predetermined upper degree and above a predetermined lower degree.

* * * * *